United States Patent [19]

Shimoyama et al.

[11] 4,363,472

[45] Dec. 14, 1982

[54] STEEL STRIP CONTINUOUS ANNEALING APPARATUS

[75] Inventors: Yuji Shimoyama; Fumiya Yanagishima, both of Ichihara; Hideo Sunami, Chiba; Yukio Ida, Chiba; Goji Katsushima, Chiba; Takeo Ohnishi, Chiba; Takeo Fukushima, Hiroshima, all of Japan

[73] Assignee: Kawasaki Steel Corporation, Hyogo, Japan

[21] Appl. No.: 201,586

[22] Filed: Oct. 28, 1980

[30] Foreign Application Priority Data

Oct. 31, 1979 [JP] Japan ..... 54-141499

[51] Int. Cl.[3] ..... C21D 9/573

[52] U.S. Cl. ..... 266/111; 148/156; 266/102; 432/59

[58] Field of Search ..... 148/153, 156, 134, 144; 266/102, 103, 108, 111, 112; 432/8, 59

[56] References Cited

U.S. PATENT DOCUMENTS

| | | | |
|---|---|---|---|
| 3,033,539 | 5/1962 | Cook et al. | 148/128 |
| 3,048,383 | 8/1962 | Champlin | 266/111 |
| 3,058,840 | 10/1962 | Kerr | 266/111 |
| 3,116,788 | 1/1964 | Beggs et al. | 266/102 |
| 3,752,458 | 8/1973 | Tokuda et al. | 148/156 |
| 3,805,571 | 4/1974 | Toda et al. | 266/108 |
| 4,270,959 | 6/1981 | Matsumoto et al. | 266/111 |

FOREIGN PATENT DOCUMENTS

| | | | |
|---|---|---|---|
| 708118 | 4/1965 | Canada | 266/111 |
| 722956 | 3/1980 | U.S.S.R. | 148/156 |

*Primary Examiner*—Peter K. Skiff
*Attorney, Agent, or Firm*—Koda and Androlia

[57] ABSTRACT

A steel strip continuous annealing apparatus comprising: a steel strip feeder; a heating-soaking zone for heating and soaking the steel strip at a predetermined temperature; a first cooling zone for rapidly cooling the steel strip at a predetermined cooling rate; a second cooling zone for slowly cooling the steel strip or holding same at a predetermined temperature; a third cooling zone for cooling the steel strip to substantially the room temperature; and a steel strip carry-out device; wherein the first cooling zone incorporates therein forcible cooling means, the second cooling zone incorporates therein hot-cold change-over means and said forcible cooling means incorporated in the first cooling zone is provided thereon with self-cooling means; so that steel strips of various grades of steel different in required heat cycle to be applied thereto can be efficiently and stably annealed.

11 Claims, 19 Drawing Figures

STEEL STRIP CONTINUOUS ANNEALING APPARATUS

BACKGROUND OF THE INVENTION

1. Field of the Invention

The present invention relates to steel strip annealing apparatuses, and more particularly to a steel strip continuous annealing apparatus comprising a heating zone, a soaking zone and cooling zones.

2. Description of the Prior Art

Recently, annealing processes for rendering predetermined processability, deep drawing properties and the like to cold-rolled steel strips have been carried out by continuous annealing apparatuses. These continuous annealing apparatuses are formed into peculiar predetermined configurations depending upo grades of steel, thickness of sheet, temperatures for heating and soaking, cooling conditions and the like.

More specifically, a continuous annealing apparatus for producing black tinplates, for example, has such a function that, in which, a steel strip having a sheet thickness of 0.15 to 0.6 mm and a sheet width of 600 to 1000 mm is soaked at a temperature of 700° to 800° C., thereafter, slowly cooled to about 450° C. from the temperature described above without rapidly cooling, and further, rapidly cooled to 100° C. to substantially room temperature, where the steel strip is not oxidized, outside the furnace, and consequently, the continuous annealing apparatus comprises a heating, a soaking, a slowly cooling and a rapidly cooling zones. In contrast thereto, a continuous annealing apparatus for producing cold-rolled steel sheets for drawing or soft black tinplates has such a function that, in which, a steel strip for producing cold-rolled steel sheet for drawing having a sheet thickness of 0.4 to 1.6 mm and a sheet width of 800 to 1500 mm or a steel strip for producing a soft black tinplate having a sheet thickness of 0.15 to 0.6 mm and a sheet width of 600 to 1000 mm is soaked to a temperature of 700° to 850° C., thereafter, rapidly cooled to a temperature of 300° to 500° C. at a cooling rate of approximately 10° to 100° C./sec, subjected to an overaging treatment being held at the temperature of 300° to 500° C. for 1 to 5 min so as to be satisfactorily softened, and then, rapidly cooled, and consequently, the continuous annealing apparatus comprises a heating, a soaking, a rapidly cooling, an overaging and a final cooling zones. Furthermore, a continuous annealing apparatus for producing high-strength cold-rolled steel sheet having a mixed structure has such a function that, in which, a steel strip having a sheet thickness and a sheet width similar to those of the cold-rolled steel sheet for drawing as described above is heated to a temperature of 800° to 850° C., caused to partially generate $\gamma$ phase in a ferrite structure, rapidly cooled at a cooling rate of approximately 10° to 100° C./sec, and turned into a product as it is. Further, a continuous annealing apparatus for producing silicon steel sheets has such a function that, in which, a steel sheet having a sheet thickness of 0.3 to 0.7 mm and a sheet width of 600 to 1000 mm can be heated to a comparatively high temperature of 800° to 1000° C. and soaked, and thereafter, cooled to substantially to room temperature without rapidly cooling, and consequently, comprises a heating zone, a soaking zone and a cooling zone. As has been described hereinabove, each continuous annealing apparatus is required to have a peculiar heat cycle depending on the material quality of the steel sheet to be annealed and a peculiar configuration depending on the dimensions of the steel sheet, and, it is difficult to treat in one and the same continuous annealing apparatus the black tinplates, cold-rolled steel sheet for drawing, soft black tinplates, high-strength cold-rolled steel sheets, silicon steel sheets or the like, which are different in required heat cycle and dimensions.

However, it is uneconomical to set the rate of conveying the steel strip at an excessively small value in a continuous annealing apparatus because the continuous annealing apparatuses each have a production capacity of 20,000 to 40,000 t/mon. on the average. Consequently, it is apparently inadvisable for an enterprise having an amount of customer's demand sufficient to constantly and sufficiently operate the respective types of continuous annealing apparatuses to possess the abovedescribed continuous annealing apparatuses meeting the conditions required for the types of steel strips. From the viewpoint as described above, necessity has been voiced for making it possible to selectively treat the black tinplates, cold-rolled steel sheets, high-strength cold-rolled steel sheets or silicon steel sheets in a single continuous annealing apparatus.

However, in the case of making it possible to selectively treat different types of steel sheets in the single continuous annealing apparatus, the steel strips for producing the soft black tinplates, cold-rolled steel sheets for drawing, high-strength cold-rolled steel sheets or the like are required to be rapidly cooled at a high rapidly cooling rate after being heated and soaked on one hand, and the steel strips for producing the black tinplates, silicon steel sheets or the like are required to be conveyed through the rapidly cooling zone at a soaking temperature on the other hand.

Here, as shown in FIGS. 1 and 2, a rapidly cooling zone 1 incorporates a plenum chamber 2 for forming means of forcible cooling, so that the steel strip being conveyed can be rapidly cooled at a predetermined cooling rate by cooling gas blown out of blow-out nozzles 3. The plenum chamber 2 and the blow-out nozzles 3 thereof are not raised in temperature during rapidly cooling of the steel strip because the cooling gas flows therethrough. However, when the steel strip is conveyed in the soaked condition through the rapidly cooling zone 1, as shown in FIG. 3, a difference in temperature between a point A on the outer surface of the plenum chamber 2 and a point B on the rear surface thereof becomes large for several to ten-odd minutes after the beginning of operation due to the radiant heat emitted from the steel strip being at high temperature, and an unbalance in stress in generated in the plenum chamber 2, whereby thermal deformation is caused to the plenum chamber 2. Further, as time goes by after the beginning of operation, the temperature of the plenum chamber 2 reaches substantially the same temperature as the temperature of the steel strip, and, when the temperature of the plenum chamber 2 is maintained high for a long period of time, the deformation of the plenum chamber by gravity progresses. In the case the deformation of the plenum chamber 2 as described above takes place, the distribution in flow rate of the cooling gas blown out of the blow-out nozzles 3 of the plenum chamber 2 changes for the worse, whereby the cooling power to the steel strip is varied to cause irregularities in cooling to the steel strip, thus presenting a problem of resulting in irregular shapes, cooling buckling and the like of the steel strip.

SUMMARY OF THE INVENTION

The present invention has been developed to obviate the abovedescribed disadvantages of the prior art and has as its object the provision of a steel strip continuous annealing apparatus wherein, particularly, steel strips different in dimensions and required heat cycle from one another can be efficiently and stably annealed.

To achieve the abovedescribed object, according to the present invention, a steel strip continuous annealing apparatus comprising: a steel strip feeder; a heating-soaking zone for heating and soaking the steel strip at a predetermined temperature; a first cooling zone for rapidly cooling the steel strip at a predetermined cooling rate; a second cooling zone for slowly cooling the steel strip or holding same at a predetermined temperature; a third cooling zone for cooling the steel strip to substantially room temperature; and a steel strip carry-out device; is of such an arrangement that the first cooling zone incorporates therein forcible cooling means, the second cooling zone incorporates therein hot-cold change-over means, the third cooling zone incorporates therein forcible cooling means and the forcible cooling means incorporated in the first cooling zone is provided thereon with self-cooling means.

BRIEF DESCRIPTION OF THE DRAWINGS

The abovementioned features and object of the invention will become more apparent with reference to the following description, taken in conjunction with the accompanying drawings, wherein like reference numerals denote like elements, and in which.

DETAILED DESCRIPTION OF THE INVENTION

Description will hereunder be given of one embodiment of the present invention with reference to the drawings.

Figure 1:
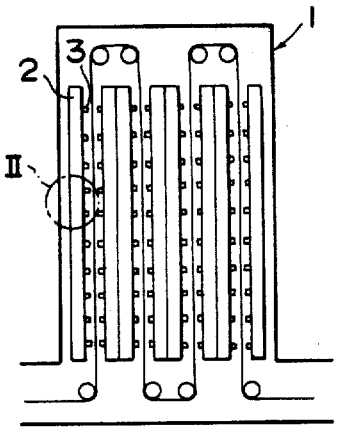
FIG. 1 is a sectional view showing the internal structure of the rapidly cooling zone in the steel strip continuous annealing apparatus of the prior art.
Figure 2:
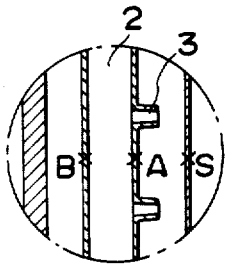
FIG. 2 is an enlarged view showing the essential portions in II of FIG. 1.
Figure 3:
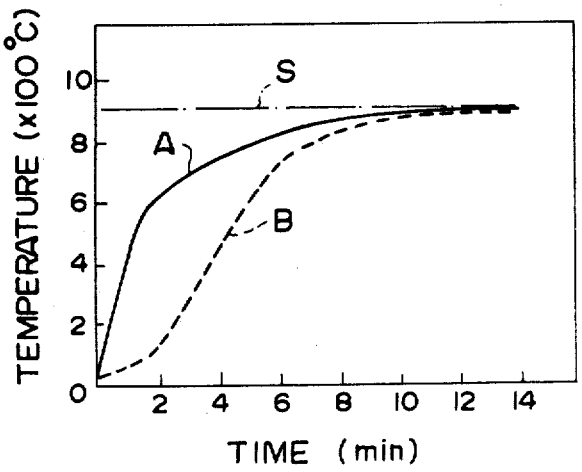
FIG. 3 is a chart showing the changes in temperature in the points where the temperatures are measured as shown in FIG. 2.
Figure 4:
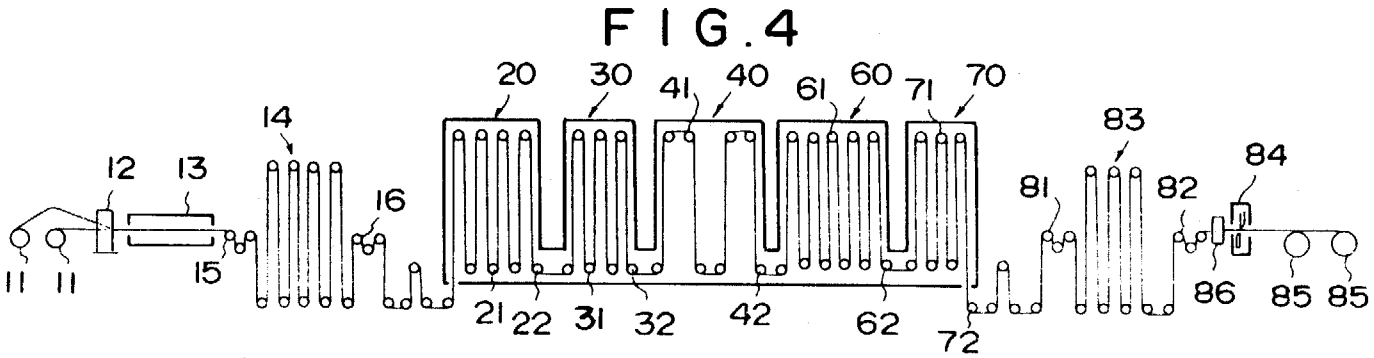
FIG. 4 is a view of general arrangement showing one embodiment of the steel strip continuous annealing apparatus according to the present invention.

FIG. 4 is an explanatory view showing the general arrangement of one embodiment of the steel strip continuous annealing apparatus according to the present invention. A steel strip feeder is provided at the inlet side of this continuous annealing apparatus as will be described below. Namely, a steel strip, which has been cold-rolled, is wound out of an uncoiler 11, connected to another steel strip in a welder 12, and rolling oil adhered to the surface of the steel strip is removed therefrom by a cleaning equipment 13. An inlet looper 14 is provided as a steel strip pool, so that connecting of a steel strip to another can be effected at the welder 12 without stopping the operation in the heating zone, and bridle rolls 15, 16 for isolating the tension of the steel strip are provided in front and rear of the inlet looper 14.

In order to make it possible to continuously anneal the steel strips of every grades of steel, at the outlet of this steel strip feeder, there are consecutively arranged a heating zone 20, a soaking zone 30, a first cooling zone 40, a second cooling zone 60 and a third cooling zone 70, all of which will hereunder be described in detail.

Hearth rolls 21 for supporting the steel strip at the top and at the bottom and conveying same are provided in the heating zone 20 which further incorporates therein heating means for elevating the temperature of the steel strip to a predetermined temperature. The steel strip, which has been elevated in temperature to a predetermined temperature in the heating zone 20, passes across deflector rolls 22 provided at the outlet of the heating zone 20, and is delivered to the soaking zone 30.

Hearth rolls 31 for supporting the steel strip at the top and at the bottom and conveying same are provided in the soaking zone 30 incorporating therein soaking means for soaking the steel strip, which has been elevated in temperature in the heating zone 20, at a predetermined temperature. The steel strip, which has been soaked at a predetermined temperature in the soaking zone 30, passes across deflector rolls 32 provided at the outlet of the soaking zone 30, and is delivered to the first cooling zone 40.

Hearth rolls 41 for supporting the steel strip at the top and at the bottom and conveying same are provided in the first cooling zone 40 which incorporates therein forcible cooling means for making it possible to rapidly cool the steel strip, which has been soaked at the predetermined soaking temperature in the soaking zone 30, as will be described hereinafter. Provided at the outlet of the first cooling zone 40 are deflector rolls 42 for delivering the steel strip to the second cooling zone 60.

Figure 6:
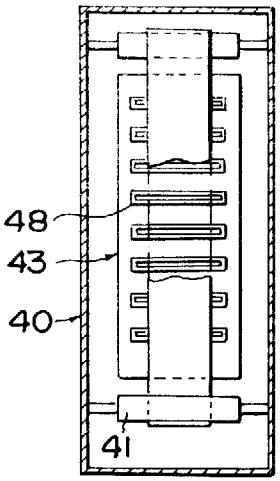
FIG. 6 is a sectional view taken along the line VI—VI in FIG. 5.
Figure 5:
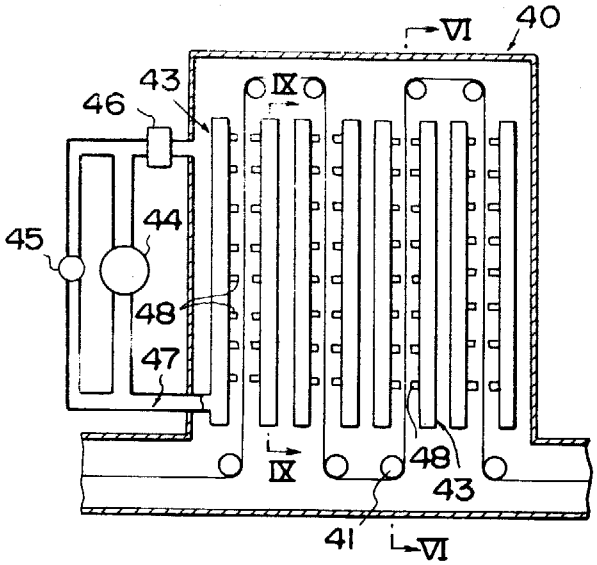
FIG. 5 is a sectional view showing the internal structure of the first cooling zone.

As shown in FIGS. 5 and 6, in this first cooling zone 40, plenum chambers 43 constituting first forcible cooling means being opposed to the opposite surfaces of the steel strip being conveyed in the respective conveying passageways are provided at opposite sides of the respective conveying passageways through which the steel strip is vertically conveyed. HN gas as the gaseous atmosphere in the furnace is delivered into the plenum chambers 43 in a state of cooling gas through a water-cooled cooler 46 and a flow rate regulating damper 47 by the driving force of a first circulating fan 44 or a second circulating fan 45. The cooling gas, which has been delivered into the plenum chambers 43 in the compressed condition, is adapted to be blown out of slit-shaped blow-out nozzles 48 formed in the surfaces of the plenum chambers 43 opposed to the steel strip.

Figure 7:
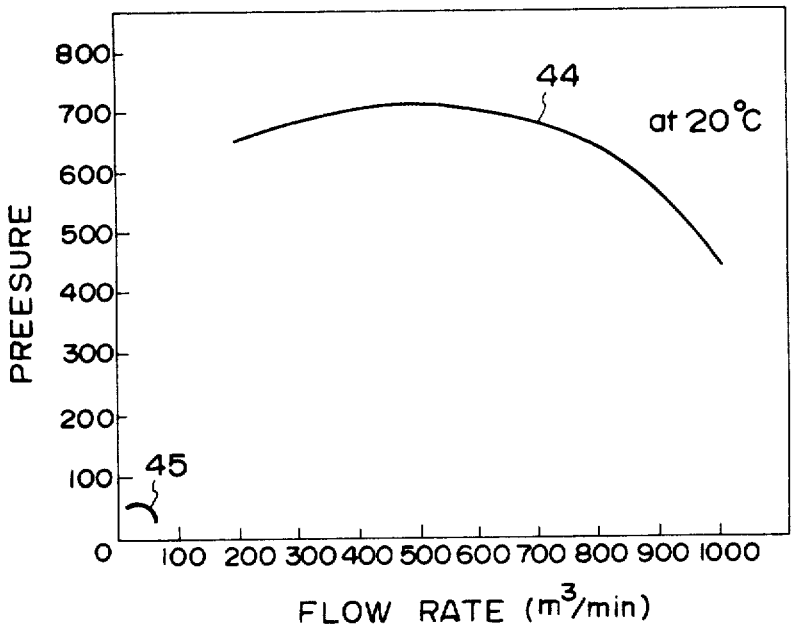
FIG. 7 is a chart showing the flow rate-pressure characteristics of the circulating fan.
Figure 8:
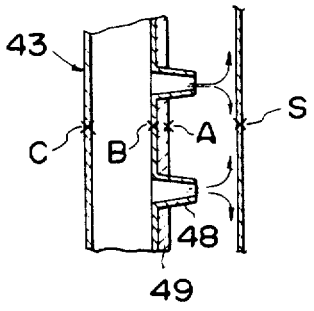
FIG. 8 is a sectional view enlargedly showing the essential portions shown in FIG. 5.

Here, to state the flow rate-pressure characteristics of the first and second circulating fans 44 and 45, the former has a large capacity, while the latter has a small capacity as respectively shown in FIG. 7. Consequently, when the first circulating fan 44 is driven, cooling gas of high flow rate is introduced into the plenum chambers 43, the cooling gas of high flow rate is blown against the surfaces of the steel strip as shown in FIG. 8, so that the steel strip can be rapidly cooled at a predetermined cooling rate. When only the second circulating fan 45 is driven, cooling gas of low flow rate is blown out of the blow-out nozzles 48 of the plenum chambers 43, and consequently, the cooling gas merely self-cools the plenum chambers 43 and the blow-out nozzles 48 of the plenum chambers 43 to prevent the rise in temperature, and does not rapidly cool the steel strip at all. In addition, heat insulating materials 49 are adhesively attached to the surfaces of the plenum chambers 43 opposed to the steel strip, so that the radiant heat emitted from the steel strip heated at high temperature does not directly act on the plenum chambers 43.

Figure 9:
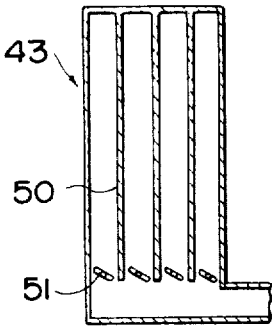
FIG. 9 is a sectional view taken along the line IX—IX in FIG. 5.

Further, as shown in FIG. 9, the interior of each plenum chamber 43 is divided in the widthwise direction by a plurality of partition walls 50, and, in flow-in portions of the respective compartments, there are provided flow rate regulating dampers 51, which are adjustable in opening degree independently of one another. More specifically, in each plenum chamber 43, the respective flow rate regulating dampers 51 are suitably regulated, whereby the distribution of flow rates of the cooling gas blown out of the blow-out nozzles 48 in the widthwise direction is controlled, so that the steel strip can be uniformly rapidly cooled in the widthwise direction thereof.

In the second cooling zone 60, there are provided hearth rolls 61 for supporting the steel strip at the top and at the bottom and conveying same, and deflector rolls 62 for delivering the steel strip to the third cooling zone 70 are provided at the outlet of the second cooling zone.

Figure 10:
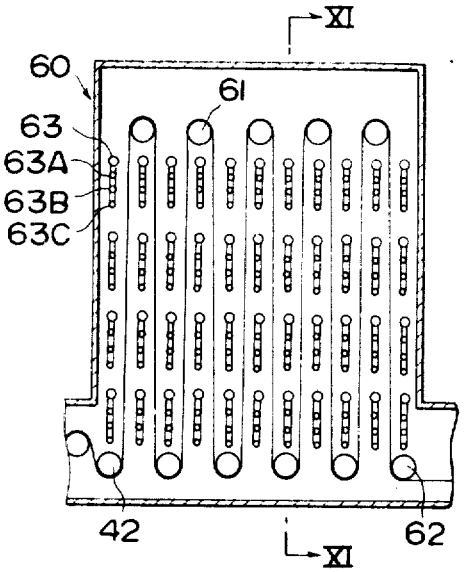
FIG. 10 is a sectional view showing the interior of the second cooling zone.
Figure 11:
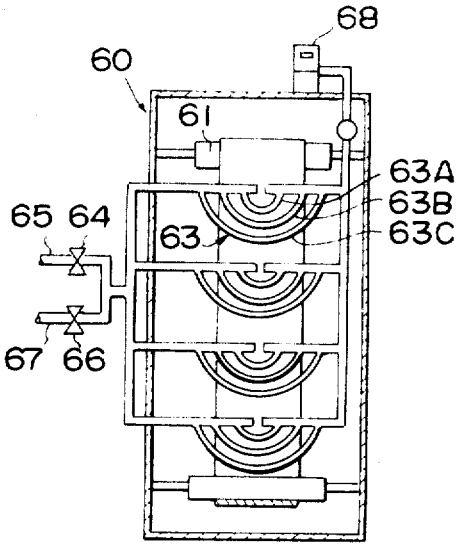
FIG. 11 is a sectional view taken along the line XI—XI in FIG. 10.

Radiators 63 constituting hot-cold change-over means, four of which are arranged in series in the vertical direction as shown in FIGS. 10 and 11, are disposed at opposite sides of the respective conveying passageways, through which the steel strip is conveyed, in the second cooling zone 60. The radiators 63 each comprise a small letter 'U' shaped first tube 63A, a medium letter 'U' shaped second tube 63B and a large letter 'U' shaped third tube 63C, all of which are opposed to the surface of the steel strip being conveyed through the respective conveying passageways. Connected to the inlet side of the radiators 63 are a heating fluid pipe 65 for introducing heating gas through a change-over valve 64 and a cooling fluid pipe 67 for introducing cooling gas through a change-over valve 66. Furthermore, connected to the outlet side of the radiators 63 is an exhaust fan 68 for discharging the heating gas or cooling gas, which has been introduced into the radiators 63. More specifically, the heating gas or cooling gas, which has been introduced into the radiators 63 by the switching operation of the change-over valve 64 or 66, passes through the first, second and third tubes 63A, 63B and 63C, being capable of slowly cooling or holding at a predetermined temperature the steel strip by the radiant heat emitted therefrom. Here, in the radiator 63, the respective tubes 63A, 63B and 63C are each provided therein with a flow rate regulating valve, not shown. When these flow rate regulating valves are operated, the flow rates of heating gas or cooling gas to the respective tubes 63A, 63B and 63C are regulated, whereby the distribution of radiant heats acting on the steel strip in the widthwise direction thereof is controlled, so that the steel strip can be uniformly slowly cooled or held at a predetermined temperature.

The steel strip, which has been slowly cooled or held at a predetermined temperature in the second cooling zone 60, subsequently can enter the third cooling zone 70. In the third cooling zone 70, there are provided hearth rolls 71 for supporting the steel strip at the top and at the bottom and conveying same, and deflector rolls 72 for deflecting and delivering the steel strip to the steel strip carry-out device are provided at the outlet of the third cooling zone.

Figure 12:
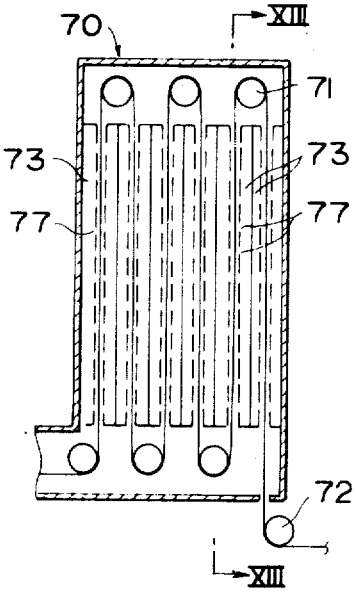
FIG. 12 is a sectional view showing the interior of the third cooling zone.
Figure 13:
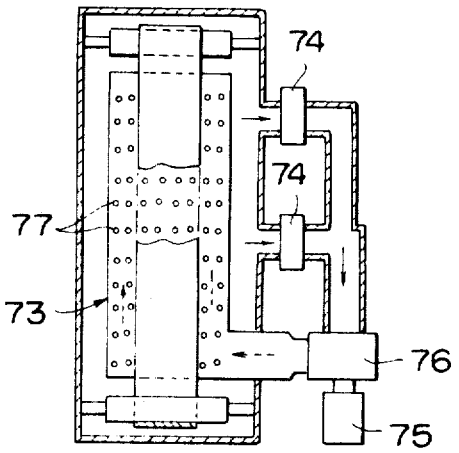
FIG. 13 is a sectional view taken along the line XIII—XIII in FIG. 12.

Furthermore, as shown in FIGS. 12 and 13, in the third cooling zone 70, plenum chambers 73 constituting second forcible cooling means are disposed at opposite sides of the respective conveying passageways, through which the steel strip is conveyed. HN gas as the gaseous atmosphere in the furnace is delivered into the inner space of plenum chambers 73 in a condition compressed by a circulating fan 76 driven by an electric motor 75 and in a condition cooled by a water-cooled cooler 74, blown out to the opposite sides of the steel strip from a plurality of blow-out openings penetrated in the surfaces of the plenum chambers 73 opposed to the respective conveying passageways for the steel strip, and can cool the steel strip substantially to room temperature.

The steel strip, which has been cooled in the third cooling zone 70, is delivered to the steel strip carry-out device outside the furnace. The steel strip carry-out device comprises: an outlet looper 83 provided in a section where the condition of tension is isolated by bridle rolls 81, 82 and making it possible to shear the steel strip in a shearing machine 84 without stopping the operation of the main body of annealing furnace; a shearing machine 84 for shearing the steel strip, which has been annealed, to a predetermined length; a recoiler 85 for winding up the steel strip, which has been shorn; an sampling means 86 including a sample punch and the like for picking up from the annealed steel strip specimens to be tested in mechanical, electromagnetic and other properties.

Description will now be given of action of the abovedescribed embodiment. The steel strip, which has been cold-rolled, is wound out by the uncoiler 11, the ends of the steel strip are connected to one another by the welder 12, rolling oil and the like are cleaned off the steel strip in the cleaning equipment 13, and thereafter, the steel strip is delivered into the main body of annealing furnace through the inlet looper 14 and the like. As will be more described hereinafter, the steel strip is annealed in each heat cycle as shown in FIG. 14 depending on the grade of steel, thereafter, passes through the outlet looper 83, thereupon, is shorn to a predetermined length in the shearing machine 84, and then, wound up by the recoiler 85.

Figure 14:
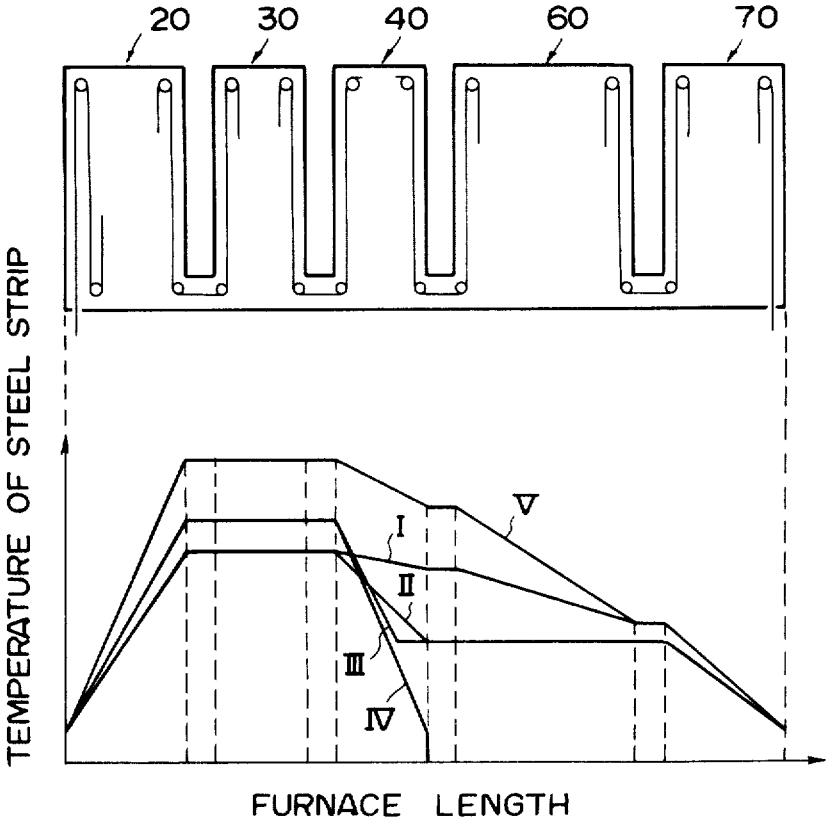
FIG. 14 is an explanatory view showing the heat cycle of the respective types of steel strips.

Here, in the case the steel strip is one for producing the black tinplate, the steel strip is annealed in the heat cycle I as shown in FIG. 14. More particularly, the steel strip is heated in the heating zone 20, soaked to a temperature of 700° to 800° C. in the soaking zone 30, and thereafter, introduced to the first cooling zone 40. In the first cooling zone 40, the first circulating fan 44 is stopped, only the second circulating fan 45 is driven, consequently, the cooling gas merely self-cools the plenum chambers 43 and the blow-out nozzles 48 thereof, the steel strip passing through the first cooling zone 40 is cooled at a low cooling rate of less than 5° C./sec, and thereafter, introduced into the second cooling zone 60. The steel strip, which has been introduced into the second cooling zone 60, receives at the opposite surfaces thereof the radiant heat emitted from the radiators 63 constituting the hot-cold change-over means in the second cooling zone 60 and into which the cooling gas is caused to flow by opening the change-over valve 66, and is slowly cooled to about 450° C. Here, the flow rate regulating valves provided in the respective tubes 63A, 63B and 63C of the radiator 63 are regulated with one another, whereby the radiant heat emitted from the radiator 63 in the widthwise direction is controlled, so that the steel strip can be slowly cooled under a uniform distribution in the widthwise direction thereof. The steel strip, which has been slowly cooled in the second cooling zone 60 as described above, is further introduced into the third cooling zone 70, rapidly cooled to substantially room temperature by the cooling gas blown out of the blow-out nozzles 77 of the plenum chambers 73 provided in the third cooling zone 70, and thereafter, discharged to the outside of the furnace. In addition, in the case this steel strip for producing the black tinplates being at high temperature passes through the first cooling zone 40 not effecting rapidly cooling, the plenum chambers 43 are protected from heat deformation because the plenum chambers 43 are self-cooled as described above and heat insulating materials are adhesively attached to the surfaces opposed to the steel strip.

In the case the steel strip is one for producing the soft black tinplates, the steel strip is treated in the heat cycle II as shown in FIG. 14, and in the case the steel strip is one for producing the cold-rolled steel sheets for drawing, the steel sheet is annealed in the heat cycle III, the heat cycles II and III being substantially similar to each other. More specifically, these steel strips are elevated in temperature in the heating zone 20, soaked to a temperature of 700° to 850° C. in the soaking zone 30, and thereafter, introduced into the first cooling zone 40. The steel strips, which have been introduced into the first cooling zone 40, are rapidly cooled to a temperature of about 300° to 500° C. at a cooling rate of approximately 30° to 50° C./sec for example, receiving at the surfaces thereof the cooling gas blown out of the slit-shaped blow-out nozzles 48 of the plenum chambers 43 by a driving force of the first circulating fan of large capacity constituting the forcible cooling means. Here, the flow rates of cooling gas flowing into the compartments divided by the partition walls 50 in the respective plenum chambers 43 are regulated by operating the respective flow rate regulating dampers 51, whereby the distribution of flow rates of the blow-out nozzles 48 in the widthwise direction are controlled, so that the steel strips can be rapidly cooled in the condition where the distribution in temperature in the widthwise direction of the steel strip is made uniform. The steel strips, which have been rapidly cooled in the first cooling zone 40 as described above, receiving the radiant heat of the radiators 63, into which heating gas is caused to flow by opening the change-over valves 64 in the second cooling zone 60, are held in the condition of temperature upon being rapidly cooled for 1 to 5 min to be subjected to the overaging treatment, softened satisfactorily, thereafter, cooled to substantially room temperature by the cooling action of the plenum chambers 73 in the third cooling zone 70, and then, carried out of the furnace.

Furthermore, in the case the steel strip is one for producing the high-strength cold-rolled steel sheets, the steel strip is annealed under a heat cycle shown as the heat cycle IV in FIG. 14. More specifically, the steel strip is heated in the heating zone 20, soaked to a temperature of 750° to 850° C. to partially generate $\gamma$ phase in the ferrite in the soaking zone 30, and thereafter, introduced into the first cooling zone 40. The steel strip, which has been introduced into the first cooling zone 40, receives at the surfaces thereof the cooling gas of high flow rate blown out of the slit-shaped blow-out nozzles 48 of the plenum chambers 43 by the driving force of the first circulating fan 44 having a high capacity and constituting the forcible cooling means in the first cooling zone 40, and rapidly cooled at a cooling rate of approximately 10° to 50° C./sec for example. Here, the flow rate regulating dampers 51 in the plenum chambers 43 are operated, whereby the distribution of blow-out quantities in the widthwise direction is regulated, so that the steel strip can be rapidly cooled in the condition where the distribution in temperature in the widthwise direction of the steel strip is made uniform. The steel strip, which has been rapidly cooled to a low temperature in the first cooling zone 40, passes through the second cooling zone 60 where the hot-cold change-over means is stopped in operation, and further, the third cooling zone 70 where the forcible cooling means is stopped in operation, and introduced to the steel strip carry-out device outside the furnace.

Further, in the case the steel strip is one for producing the silicon steel sheets, the steel strip is annealed under a heat cycle shown as the heat cycle V in FIG. 14. More specifically, the steel strip is heated in the heating zone 20, soaked to a comparatively high temperature of approximately 800° to 1000° C., and thereafter, introduced into the first cooling zone 40. Here, the forcible cooling means in the first cooling zone 40, being driven by the second circulating fan 45 only but not by the first circulating fan 44 being stopped in operation, causes the cooling gas to cool the steel strip at a low cooling rate of less than 5° C./sec without rapidly cooling the steel strip at all, so that the plenum chambers 43 and the blow-out nozzles 48 thereof can be protected from heat deformation. The steel strip passes through the first cooling zone 40 and the second cooling zone 60, and further, is introduced into the third cooling zone 70. In the second cooling zone 60 and the third cooling zone 70, the steel strip is slowly cooled by cooling actions of the radiators 63 constituting the hot-cold change-over means and the plenum chambers 73 constituting the forcible cooling means, respectively, and thereafter, introduced to the steel strip carry-out device outside the furnace.

In the abovedescribed embodiment, the forcible cooling means provided in the first cooling zone 40 as the rapidly cooling zone has the self-cooling device, whereby the heat deformation of the plenum chambers and the like can be reliably protected from the radiant heat emitted from the steel strips for producing the black tinplates or silicon steel sheets passing thereby at high temperature without being rapidly cooled, so that the steel strips different in the grades of steel such as the black tinplate, soft black tinplate, cold-rolled steel sheet for drawing, high-strength cold-rolled steel sheet, silicon steel sheet can be annealed in a single continuous annealing apparatus. Consequently, even if the quantities of the various grades of steel required to be treated are respectively small, the operating efficiency of this continuous annealing apparatus can be maintained to be high.

In addition, in the abovedescribed embodiment, in the case the steel strip is one for producing the black tinplates to be treated under the heat cycle I and the silicon steel sheets to be treated under the heat cycle V, the temperature of the steel sheet, temperature of the outer surface A of the heat insulating material 49, temperature of the outer surface B of the plenum chamber 43 and temperature of the rear surface C of the plenum chamber 43 are shown in Table 1 as the observed values, and it is found that the plenum chambers 43 are prevented from being raised in temperature by the self-cooling action thereof, thereby enabling to control the heat deformation.

TABLE 1

| Grade of steel | Heat cycle | Temperature °C. S | A | B | C |
|---|---|---|---|---|---|
| Black tinplate | I | 700 | 673 | 272 | 238 |
| Silicon steel sheet | V | 900 | 864 | 289 | 247 |

Figure 15:
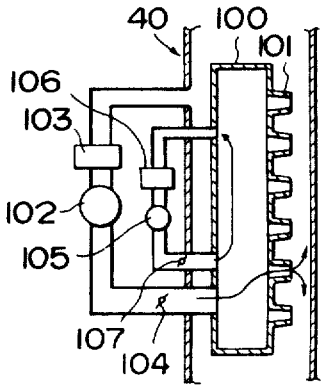
FIG. 15 is a sectional view showing a modification of the forcible cooling means in the first cooling zone.

FIG. 15 is an explanatory view showing a modification of the forcible cooling means incorporated in the first cooling zone 40 in the abovedescribed embodiment. More specifically, the plenum chambers 100 opposed to the surfaces of the steel strip being conveyed in the respective conveying passageways in the first cooling zone 40 are provided thereon with blow-out nozzles 101 for blowing out the cooling gas to the surfaces of the steel strip. The gaseous atmosphere in the furnace is cooled in a cooler 103 by a driving force of a first circulating fan 102 having a high capacity, thereafter, regulated in flow rate in a first damper 104, delivered to the plenum chamber 100 in the compressed condition, and blown out of the blow-out nozzles 101 as described above. Furthermore, cooling gas cooled in a cooler 106 by a driving force of a second circulating fan 105 may be circulated at a low flow rate through flow rate regulation of a second damper 107 immediately behind the plenum chamber 100.

More specifically, in the case the steel strip is rapidly cooled in the first cooling zone 40, the first circulating fan 102 is driven to blow out cooling gas of high flow rate from the blow-out nozzles 101 toward the steel strip, and in the case the steel strip being at high temperature without being rapidly cooled is conveyed through the first cooling zone 40, if the first circulating fan 102 is stopped in operation and the second circulating fan 105 is driven so as to circulate cooling gas only through the plenum chamber 100, then the steel strip is not rapidly cooled and the plenum chamber 100 and the blow-out nozzles 101 are self-cooled, so that the plenum chamber 100 and the blow-out nozzles 101 can be prevented from being raised in temperature and protected from heat deformation.

Figure 16:
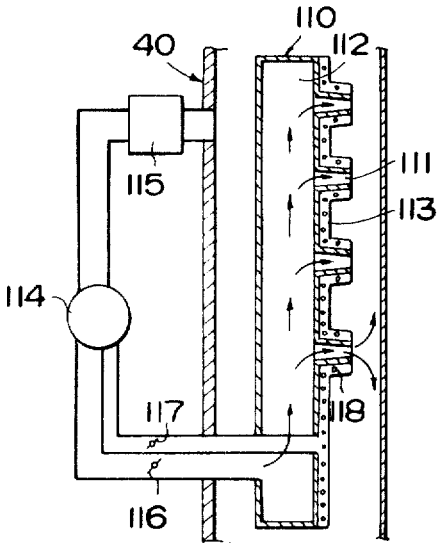
FIG. 16 is a sectional view showing another modification of the forcible cooling means in the first cooling zone.
Figure 17:
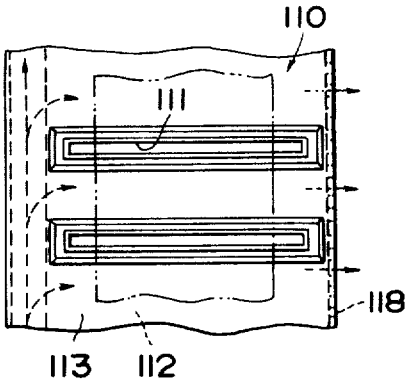
FIG. 17 is a front view of FIG. 16.

FIGS. 16 and 17 are explanatory views another modification of the forcible cooling means provided in the first cooling zone 40 of the abovedescribed embodiment. More specifically, the plenum chamber 110 comprises a main chamber 112 provided with blow-out nozzles 111 and an auxiliary chamber 113 covering the outer surface of the main chamber 112 opposed to the steel strip. A circulating fan 114 can deliver the gaseous atmosphere in the furnace as in the cooled condition cooled by a cooler 115 into the main chamber 112 through a main damper 116 and further can deliver same into the auxiliary chamber 113 through an auxiliary damper 117. The cooling gas, which has been introduced into the main chamber 112, is blown out of the blow-out nozzles 111 toward the steel strip, the cooling gas, which has been introduced into the auxiliary chamber 113, travels over the surface of the plenum chamber 110 in the widthwise direction to self-cool the plenum chamber 110, and thereafter, flows out into the furnace through exhaust openings 118 penetrated at the side of the auxiliary chamber 113.

More specifically, in the case the steel strip is rapidly cooled in the first cooling zone 40, both the main damper 116 and auxiliary damper 117 are opened, the plenum chambers 110 are self-cooled by the cooling gas flowing through the auxiliary chambers 113 and the cooling gas of high flow rate is blown out of the blow-out nozzles 111 of the main chambers to the surfaces of the steel strip. Furthermore, in the case the steel strip being at high temperature without being rapidly cooled is conveyed, if the main dampers 116 are closed and only the auxiliary dampers 117 are opened, then the plenum chambers 110 and the blow-out nozzles 111 thereof are cooled by self-cooling action of the cooling gas flowing through the auxiliary chambers 113, so that the plenum chambers 110 and the blow-out nozzles 111 thereof can be prevented from being raised in temperature and protected from heat deformation.

Figure 18:
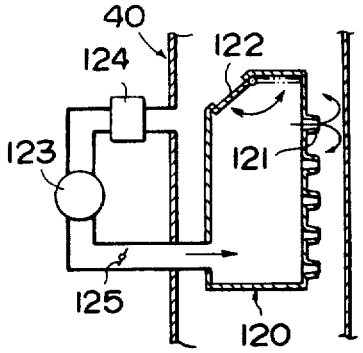
FIG. 18 is a further modification of the forcible cooling means in the first cooling zone.

FIG. 18 is an explanatory view showing a further modification of the forcible cooling means provided in the first cooling zone 40 of the abovedescribed embodiment. More specifically, blow-out nozzles 121 are provided in the surface of a plenum chamber 120 opposed to the steel strip, and a bypass flap 122 capable of forming a large opening area is provided in the rear surface of the plenum chamber 120. The gaseous atmosphere in the furnace is cooled in a cooler 124 by a driving force of a circulating fan 123, thereafter, passes through a flow rate regulating damper 125 and is introduced into the plenum chamber 120, when the bypass flap 122 is closed, blown out of the blow-out nozzles 121 to the surface of the steel strip, and, when the bypass flap 122 is opened, discharged into the furnace through an opening formed by the bypass flap 122 without being blown out of the blow-out nozzles 121.

In other words, in the case the steel strip is rapidly cooled in the first cooling zone 40, the bypass flaps 122 are closed and the cooling gas of high flow rate is blown out of the blow-out nozzles 121 to the surfaces of the steel strip. In the case the steel strip being at high temperature without being rapidly cooled is conveyed, the bypass flaps 122 are opened, the cooling gas is caused to flow out into the furnace out of the openings formed by the bypass flaps 122 through the plenum chambers 120 without being blown out of the blow-out nozzles 121, so that the plenum chambers 120 and the blow-out nozzles 121 thereof can be prevented from being raised in temperature and protected from heat deformation by self-cooling action of the cooling gas.

Figure 19:
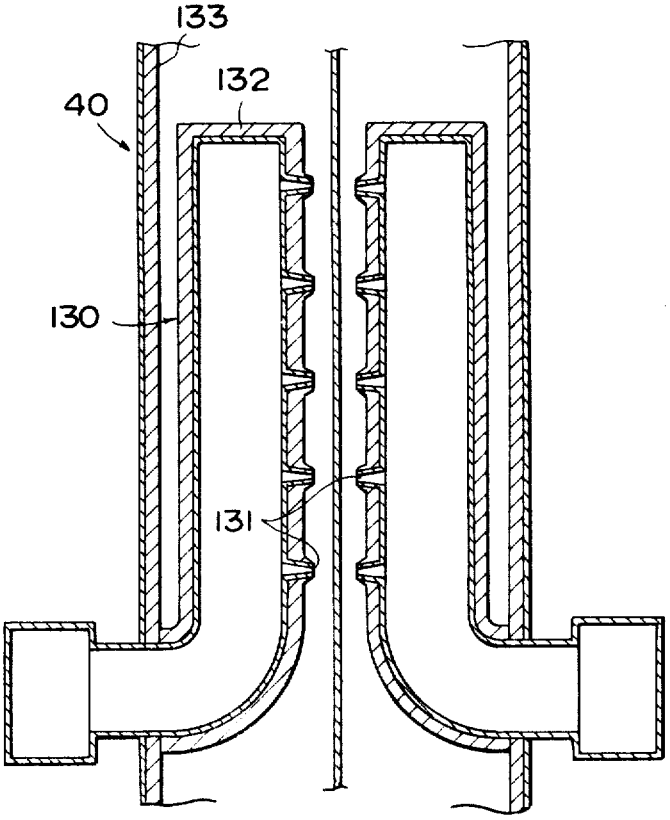
FIG. 19 is a sectional view showing a still further modification thereof.

FIG. 19 is an explanatory view showing a modification of the main body of casing and the forcible cooling means in the first cooling zone 40 of the above-described embodiment. More specifically, the entire areas of the outer surfaces of a plenum chamber 130 and blow-out nozzles 131 thereof are covered by a heat insulating material 132, and the inner surface of the main body of casing is covered by a heat insulating material 133. In other words, in the use of the first cooling zone 40 as described above, the radiant heat emitted from the steel strip being at high temperature is isolated by heat isolating materials 132 and 133. Consequently, even in the case the steel strip being at temperature without being rapidly cooled is conveyed, the plenum chambers 130, the blow-out nozzles 131 and the main body of casing can be protected from heat deformation.

It should be apparent to one skilled in the art that the abovedescribed embodiment are merely illustrative of but a few of the many possible specific embodiments of the present invention. Numerous and varied other arrangements can be readily devised by those skilled in the art without departing from the spirit and scope of the invention.

What is claimed is:

1. A steel strip continuous annealing apparatus for annealing a steel strip comprising:
- a steel strip feeder;
- a heating-soaking zone for heating and soaking the steel strip at a predetermined temperature;
- a first cooling zone including first forcible cooling means for rapidly cooling the steel strip at a predetermined cooling rate, said first forcible cooling means provided thereon with self-cooling means for cooling said first forcible cooling means;
- a second cooling zone including hot-cold change-over means for selectively either slowly cooling the steel strip or applying heat to the steel strip to hold the steel strip at a predetermined temperature;
- a third cooling zone including second forcible cooling means for cooling the steel strip to substantially room temperature; and
- a steel strip carry out device.

2. A steel strip continuous annealing apparatus as set forth in claim 1, wherein said forcible cooling means incorporated in the first cooling zone comprises cooling gas blow-out devices which blow out cooling gas from plenum chambers opposed to the opposite surfaces of the steel strip.

3. A steel strip continuous annealing apparatus as set forth in claim 1, wherein said hot-cold change-over means comprises:
- a radiator opposed to the opposite surface of the steel strip;
- a heating fluid pipe for introducing heating gas to said radiator;
- a cooling fluid pipe for introducing cooling gas to said radiator; and
- changeover valve means for selectively opening said heating fluid pipe or said cooling fluid pipe.

4. A steel strip continuous annealing apparatus as set forth in claim 1, wherein said forcible cooling means incorporated in the third cooling zone is constituted by cooling gas blow-out devices which blow out cooling gas from the plenum chambers opposed to the opposite surfaces of the steel strip.

5. A steel strip continuous annealing apparatus as set forth in claim 1, wherein said steel strip feeder includes an uncoiler, a cleaning equipment and a looper.

6. A steel strip continuous annealing apparatus as set forth in claim 1, wherein said steel strip carry-out device includes a looper, a sampling means and a recoiler.

7. A steel strip continuous annealing apparatus as set forth in claim 2, wherein said first forcible cooling means comprises a first circulating fan for blowing out cooling gas of high flow rate from blow-out nozzles of the plenum chambers to forcibly cool the steel strip and a second circulating fan for blowing out cooling gas of low flow rate from blow-out nozzles of the plenum chambers to self-cool the plenum chambers.

8. A steel strip continuous annealing apparatus as set forth in claim 2, wherein said first forcible cooling means comprises a first circulating fan for blowing out cooling gas of high flow rate from blow-out nozzles of the plenum chambers to forcibly cool the steel strip and a second circulating fan for circulating cooling gas of low flow rate within the plenum chamber to self-cool the plenum chambers.

9. A steel strip continuous annealing apparatus as set forth in claim 2, wherein said plenum chamber comprises a main chamber for blowing out cooling gas to forcibly cool the steel strip and an auxiliary chamber provided at the side of the main chamber opposed to the steel strip and through which cooling gas for self-cooling the plenum chamber flows.

10. A steel strip continuous annealing apparatus as set forth in claim 2, wherein said plenum chamber is provided with a bypass flap adapted to be closed when the steel strip is forcibly cooled and to be opened when the plenum chambers cool themselves.

11. A steel strip continuous annealing apparatus as set forth in claim 2, wherein the outer surface of said plenum chamber is covered with a heat insulating material.

* * * * *